US011433510B2

(12) United States Patent
Yoshida

(10) Patent No.: US 11,433,510 B2
(45) Date of Patent: Sep. 6, 2022

(54) SUPPORT JIG FOR VIBRATIONPROOF MATERIAL AND ASSEMBLING DEVICE FOR VIBRATIONPROOF DEVICE

(71) Applicant: TOYO TIRE CORPORATION, Itami (JP)

(72) Inventor: Hiroyuki Yoshida, Itami (JP)

(73) Assignee: TOYO TIRE CORPORATION, Itami (JP)

( * ) Notice: Subject to any disclaimer, the term of this patent is extended or adjusted under 35 U.S.C. 154(b) by 0 days.

(21) Appl. No.: 17/186,091

(22) Filed: Feb. 26, 2021

(65) Prior Publication Data

US 2021/0291323 A1 Sep. 23, 2021

(30) Foreign Application Priority Data

Mar. 19, 2020 (JP) ..... JP2020-049757

(51) Int. Cl.
*B25B 11/02* (2006.01)
*B25B 27/00* (2006.01)

(52) U.S. Cl.
CPC ..... *B25B 11/02* (2013.01); *B25B 27/0035* (2013.01)

(58) Field of Classification Search
CPC ..... B25B 11/02; B25B 27/0035
See application file for complete search history.

(56) References Cited

U.S. PATENT DOCUMENTS 9,384,621 B1 * 7/2016 Chang ..... G07F 11/44

FOREIGN PATENT DOCUMENTS

JP 11-159566 A 6/1999

OTHER PUBLICATIONS youtube.com/watch?v=J4dyrZnV-98 Café X Robotic Coffeebar 2.0 published Feb. 22, 2018 (Year: 2018).*
youtube.com/watch?v=xTm5kwLEnBs Transforming Car Cup Holder—5 in 1 Mug published May 18, 2018 (Year: 2018).*

* cited by examiner

*Primary Examiner* — Moshe Wilensky
(74) *Attorney, Agent, or Firm* — WHDA, LLP

(57) ABSTRACT

A support jig is configured to be capable of supporting a first anti-vibration material including a first outer cylinder and a second anti-vibration material including a second outer cylinder, the support jig including a jig main body that accommodates lower portions of the first and second anti-vibration materials, and an adapter configured to be selectively attachable onto an upper portion of the jig main body. The jig main body includes, at an upper end portion, a main body counterbore portion for supporting the first anti-vibration material from below while horizontally positioning the first anti-vibration material at the first outer cylinder, in a state where no adapter is attached. The adapter includes, at an upper end portion, an adapter counterbore portion for supporting the second anti-vibration material from below while horizontally positioning the second anti-vibration material at the second outer cylinder, in a state where the adapter is attached.

11 Claims, 10 Drawing Sheets

SUPPORT JIG FOR VIBRATIONPROOF MATERIAL AND ASSEMBLING DEVICE FOR VIBRATIONPROOF DEVICE

CROSS-REFERENCE TO RELATED APPLICATIONS

This application claims priority of Japanese Patent Application No. 2020-049757 filed on Mar. 19, 2020, the content of which is incorporated herein by reference.

BACKGROUND OF THE INVENTION

Technical Field

The present invention relates to a support jig for an anti-vibration material and an assembling device for an anti-vibration device.

Related Art

JP H11-159566 A discloses a liquid-filled anti-vibration device (referred to as an anti-vibration device) that is interposed between an engine and a vehicle body for supporting the engine and that elastically supports the engine with respect to the vehicle body. Such an anti-vibration device includes a main body that is a rubber elastic body and that includes a liquid chamber at an upper part, a first substrate provided at an upper part of the main body and secured to the engine, a second substrate provided at a lower part of the main body and secured to the vehicle body, a partition member assembled in a liquid chamber, and a diaphragm assembled in an opening portion of the liquid chamber to seal the liquid in the liquid chamber. In addition, the anti-vibration device of JP H11-159566 A further includes a lid member attached from above the partition member, the diaphragm and the first substrate, on an upper part of the main body.

By filling the liquid chamber of the main body with a liquid while the partition member is assembled in the liquid chamber, and assembling the diaphragm to seal at the opening portion of the liquid chamber, the anti-vibration material is assembled. Then, by assembling the lid member in the anti-vibration material from above, the anti-vibration device is produced.

SUMMARY

The anti-vibration device includes a tubular outer cylinder attached, as a first substrate, to the outer circumferential portion of the main body, and a lid member having a tubular circumferential wall portion. By externally fitting the circumferential wall portion of the lid member with the outer cylinder, the lid member may be secured to the outer cylinder.

In this case, in a state where the anti-vibration material in which the outer cylinder is assembled is supported from below and horizontally positioned at the outer cylinder in a posture in which the axial line is oriented vertically, the lid member is externally fitted with the outer cylinder from above, and therefore an anti-vibration device is produced. The support jig for supporting the anti-vibration material while positioning the anti-vibration material includes a counterbore portion at an upper part to correspond to an outer diameter of a lower part of the outer cylinder.

Here, there may be a plurality of types of anti-vibration devices respectively having different anti-vibration characteristics depending on the required performance. In addition, there may be different types of anti-vibration devices depending on the shape of a mating component to be attached. For example, there may be a plurality of types of anti-vibration devices respectively having different outer cylinder diameters. In this case, each support jigs for the anti-vibration devices has the counterbore portion which is formed according to the outer cylinder of each anti-vibration device to be produced.

As a result, in a case where a plurality of types of anti-vibration devices having different shapes are produced in a mixed manner on a production line, it is necessary to make a changeover to a dedicated support jig to correspond to the outer cylinder shape of the anti-vibration material. As a result, the production line is stopped for a long time whenever the changeover occurs. Hence, the productivity is lowered.

An object of the present invention is to provide a support jig for an anti-vibration material capable of improving the productivity, in a case where a plurality of types of anti-vibration materials are mixed in the production of the anti-vibration devices.

According to one aspect of the present invention, a support jig for an anti-vibration material is provided, the support jig supporting the anti-vibration material, which is a constituent element of an anti-vibration device and which includes an outer cylinder having a tubular shape, at the outer cylinder from below in a posture in which an axial line is vertically oriented, the support jig including: a jig main body that accommodates a lower part of the anti-vibration material in an inside; and an adapter configured to be selectively attachable onto an upper part of the jig main body, wherein the support jig is configured to be capable of supporting a plurality of types of anti-vibration materials including a first anti-vibration material and a second anti-vibration material, the first anti-vibration material including a first outer cylinder, the second anti-vibration material including a second outer cylinder, the second outer cylinder having a diameter different from a diameter of the first outer cylinder, wherein the jig main body includes, at an upper end portion, a first support portion for supporting the first anti-vibration material from below while horizontally positioning the first anti-vibration material at the first outer cylinder, in a state where no adapter is attached, and wherein the adapter includes, at an upper end portion, a second support portion for supporting the second anti-vibration material from below while horizontally positioning the second anti-vibration material at the second outer cylinder, in a state where the adapter is attached.

According to the present invention, the support jig for the anti-vibration material is capable of supporting a plurality of types of anti-vibration materials while horizontally positioning the anti-vibration materials by selectively installing an adapter. Accordingly, it is sufficient to selectively install an adapter having a light weight according to the type of the anti-vibration material to be supported. This configuration eliminates the need for attaching or detaching the jig main body. Therefore, the operation in a changeover of the support jig according to the anti-vibration device to be produced can be performed in a shorter period by selectively installing the adapter than a case where the entire jig is replaced. Therefore, downtime of a production line due to the changeover can be shortened. Therefore, the productivity of the production line is improved.

The jig main body may include a counterbore portion, the adapter may include a protrusion having an annular shape and protruding downward, and the adapter may be positioned with respect to the jig main body by fitting the protrusion in the counterbore portion, in a state where the adapter is installed on an upper part of the jig main body.

According to the present configuration, the adapter can be easily positioned with respect to the jig main body.

The counterbore portion may be realized by the first support portion.

According to the present configuration, the jig main body can be simplified as compared to a case where the counterbore portion and the first support portion are provided separately. Accordingly, the cost of the jig main body can be reduced.

The adapter may be installed on the jig main body by being attracted by a magnetic force.

According to the present configuration, the adapter can be easily installed to the jig main body as compared to a case where the adapter is installed to the jig main body by a fastening member, and the time necessary for the change-over operation can be shortened.

The jig main body may include a positioning portion that positions a lower end portion of the anti-vibration material in a rotation direction around an axial center of the lower end portion.

According to the present configuration, since the anti-vibration material can be supported while being positioned in the rotational direction, it is easy to assemble another member with respect to the anti-vibration material on a predetermined phase (direction) in the rotational direction.

Further, a length from the second outer cylinder of the second anti-vibration material to a lower end portion of the second anti-vibration material may be longer than a length from the first outer cylinder of the first anti-vibration material to a lower end portion of the first anti-vibration material.

Further, the jig main body may be configured such that an upper support portion having a cylindrical shape and a lower support portion having a disc shape are connected with each other.

Further, the positioning portion may be configured to be capable of positioning one of the lower end portions of the first anti-vibration material and the second anti-vibration material by external fitting, and to be capable of positioning the other one of the lower end portions by internal fitting.

Further, according to another aspect of the present invention, an assembling device for an anti-vibration device is provided, the assembling device including: the support jig for the anti-vibration material; and a robot arm that assembles an actuator to the anti-vibration device mounted on the support jig.

The assembling device for the anti-vibration device may further include a sensor that detects a presence or absence of an adapter on the support jig. Further, the assembling device for the anti-vibration device may further include a sensor that detects a posture of the anti-vibration material mounted on the support jig. Furthermore, the assembling device for the anti-vibration device may further include a sensor that detects the actuator assembled in the anti-vibration material mounted on the support jig.

According to the present invention, the productivity can be improved, in a case where a plurality of types of anti-vibration materials are mixed in the production of the anti-vibration devices.

BRIEF DESCRIPTION OF THE DRAWINGS

The foregoing and the other features of the present invention will become apparent from the following description and drawings of an illustrative embodiment of the invention in which.

DETAILED DESCRIPTION OF EMBODIMENTS

Hereinafter, embodiments according to the present invention will be described with reference to the accompanying drawings. It is to be noted that the following description is essentially exemplification, and is not intended to limit the present invention, applications thereof, or uses thereof. In addition, the drawings are schematic, and the ratios of the respective dimensions are different from the actual ones.

Figure 1:
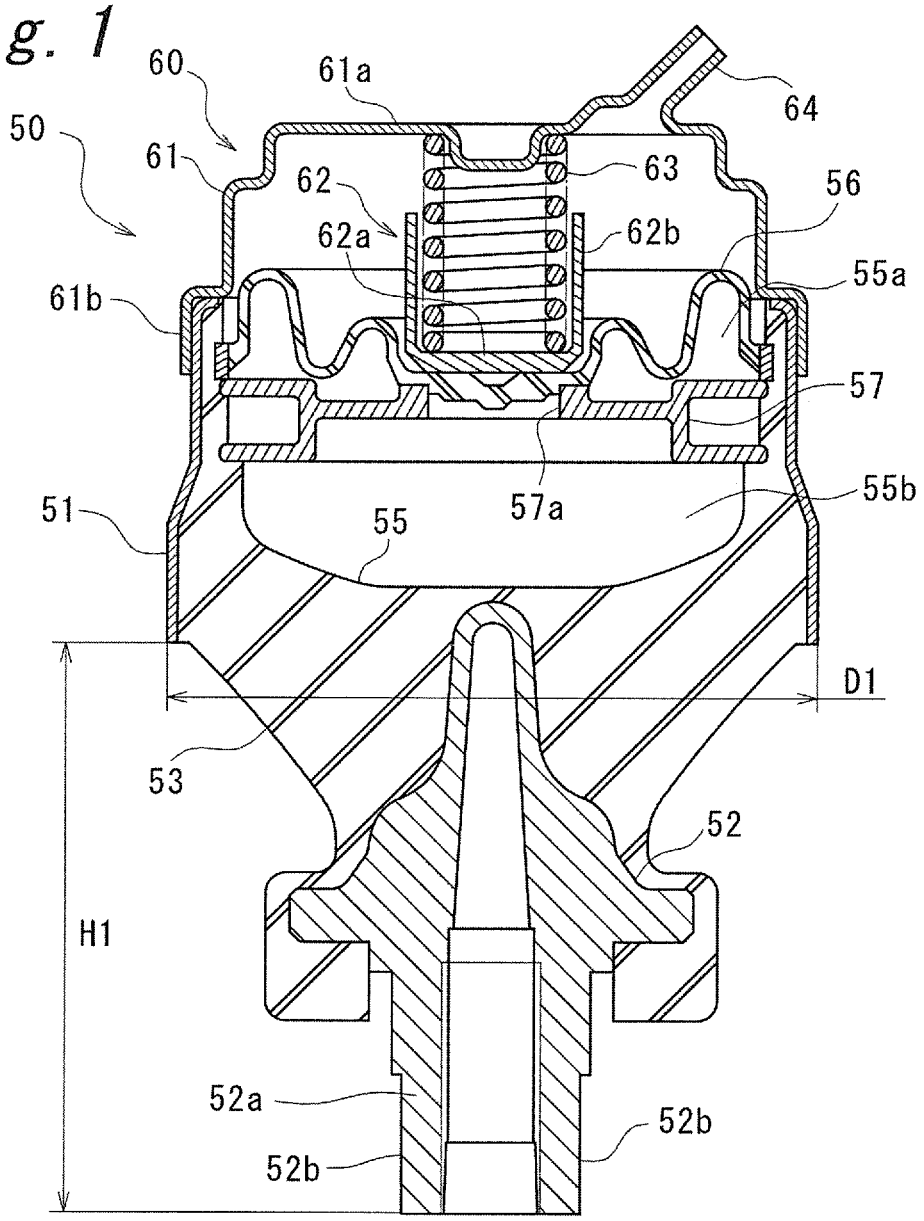
FIG. 1 is a vertical cross-sectional view of a first anti-vibration device.

FIG. 1 shows a vertical cross-sectional view of a first anti-vibration device 50 as an example of an anti-vibration device. The first anti-vibration device 50 is interposed between an engine and a vehicle body, which are not shown, to elastically support the engine with respect to the vehicle body. The first anti-vibration device 50 includes an elastic base body 53 made of a rubber member formed to be vertically long, a first outer cylinder 51 provided on the outer circumference of one end portion (an upper end portion in FIG. 1) in the long direction, and a first core material 52 provided at an axial center of the other end portion (a lower end portion).

The first outer cylinder 51 is a cylindrical metal member, and is attached by caulking to an outer circumferential portion at an upper end of the elastic base body 53. The first core material 52 is vulcanized and bonded with the inside of a lower part of the elastic base body 53, and includes a core material protrusion portion 52*a*, a lower end portion of which protrudes downward with respect to the elastic base body 53. The core material protrusion portion 52*a* is a columnar rod-shaped member, and a pair of flat surface portions 52*b* facing each other with a width W are formed on a lower side portion. The first anti-vibration device 50 is attached to the vehicle body through the first outer cylinder 51, and is attached to the engine through the first core material 52.

A liquid chamber 55 opened upward is formed on an upper portion of the elastic base body 53. A partition member 57 is assembled in the liquid chamber 55. The liquid chamber 55 is divided by the partition member 57 into a first chamber 55*a* on an upper side and a second chamber 55*b* on a lower side. An orifice passage 57*a* for communicating the first chamber 55*a* and the second chamber 55*b* is formed in the partition member 57. In addition, a diaphragm 56 is assembled in an opening edge portion of the liquid chamber 55, and a liquid such as water, ethylene glycol, silicone oil, or the like is sealed inside the liquid chamber 55.

The first anti-vibration device 50 further includes, at an upper part, a first actuator 60 for displacing the vertical position of the diaphragm 56. The first actuator 60 includes a lid member 61, a movable element 62 capable of moving up and down inside the lid member 61, and a spring 63 for urging the movable element 62 downward.

The lid member 61 includes a top wall portion 61*a* having a disc shape, and a wall portion 61*b* having an annular shape and extending downward from a circumferential edge portion of the top wall portion 61*a*. The top wall portion 61*a* includes a nipple 64 for communicating vertically through the top wall portion 61*a*. The lid member 61 is secured to the first outer cylinder 51 by externally fitting the annular wall portion 61*b* from the outside in the radial direction. With the lid member 61 secured to the first outer cylinder 51, a sealed space is formed between the lid member 61 and the diaphragm 56. The nipple 64 is connected to a negative pressure source, not shown, through a valve.

The movable element 62 includes a bottom wall portion 62*a* having a disc shape, and a wall portion 62*b* having an annular shape and extending upward from a circumferential edge portion of the bottom wall portion 62*a*. The spring 63 is elastically provided between the top wall portion 61*a* of the lid member 61 and the bottom wall portion 62*a* of the movable element 62, and urges the movable element 62 downward.

In the state shown in FIG. 1, the diaphragm 56 is pressed downward by the movable element 62 to block the orifice passage 57*a* of the partition member 57. Although not shown, by reducing the pressure in the sealed space in the first actuator 60, the diaphragm 56 and the movable element 62 can be displaced upward against the urging force of the spring 63. Accordingly, the diaphragm 56 can be separated upward from the partition member 57 to open the orifice passage 57*a*.

Figure 2:
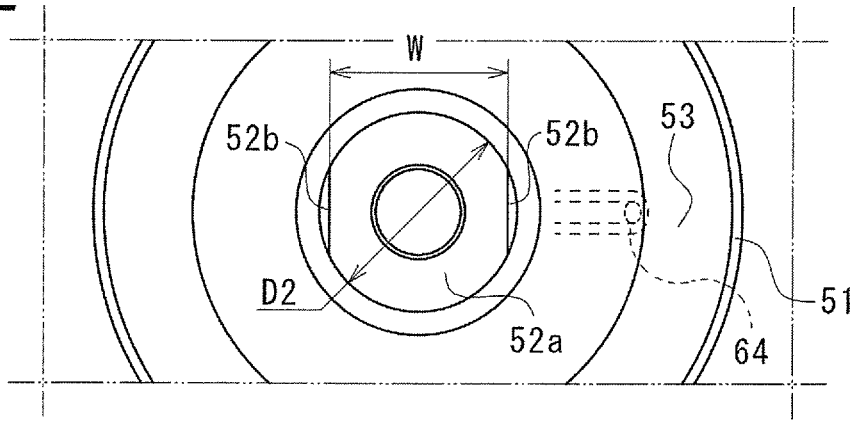
FIG. 2 is a bottom view of the first anti-vibration device.

FIG. 2 is a bottom view of the first anti-vibration device 50. As shown in FIG. 2, the first actuator 60 is secured to the first outer cylinder 51, so that the nipple 64 has a predetermined angle with respect to the flat surface portions 52*b* of the first core material 52. Accordingly, the nipple 64 can be regulated in a predetermined direction in a case where the first anti-vibration device 50 is positioned and secured to the engine at the core material protrusion portion 52*a* by using the flat surface portions 52*b*. This configuration facilitates the arrangement of piping to the nipple 64. For example, in the present embodiment, the nipple 64 extends in a direction orthogonal to the flat surface portions 52*b*.

Figure 3:
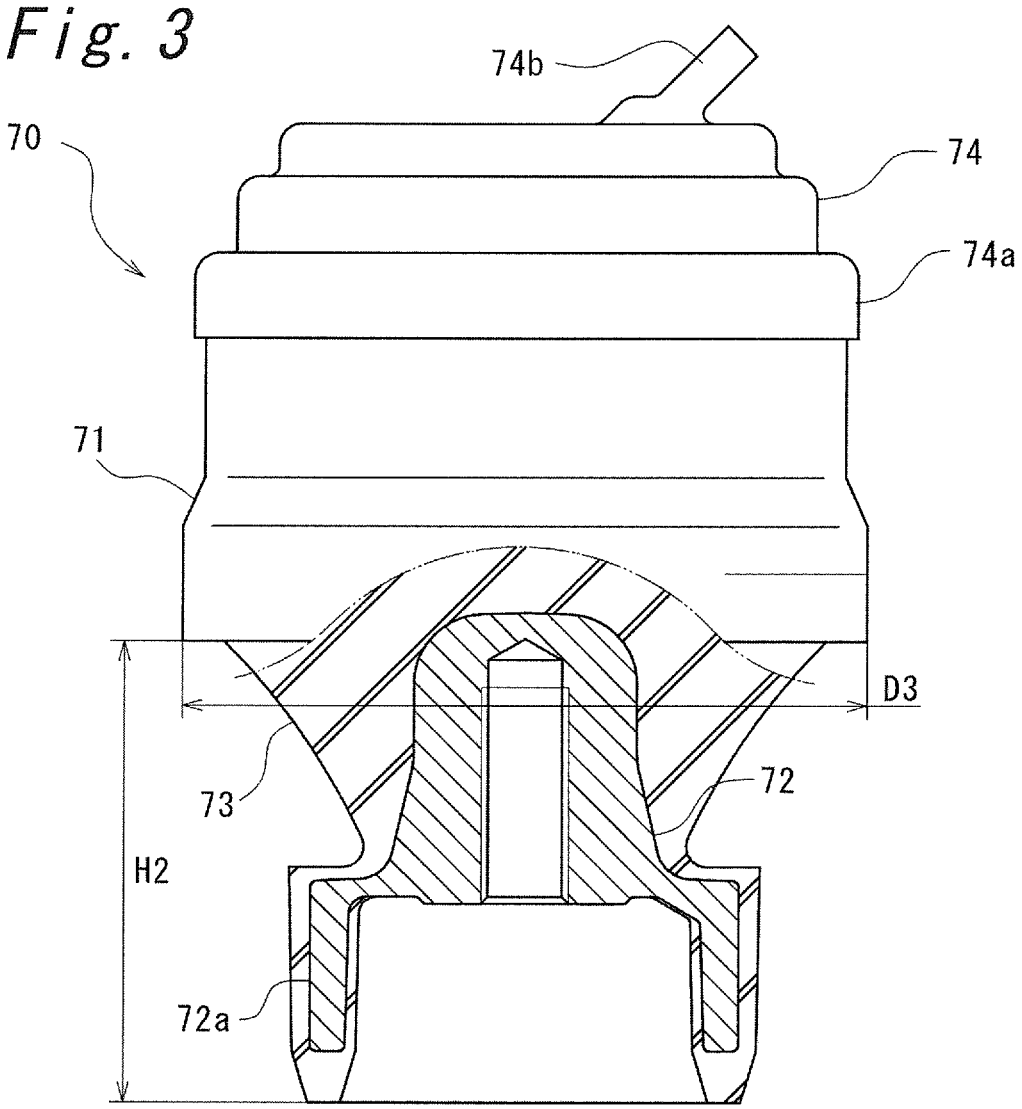
FIG. 3 is a front view of a second anti-vibration device.

FIG. 3 shows a front view of a second anti-vibration device 70 as another example of the anti-vibration device, and a part of the lower part is shown in a cross section. The second anti-vibration device 70 is also configured in the same manner as the first anti-vibration device 50, and is interposed between the engine and the vehicle body, which are not shown, to elastically support the engine with respect to the vehicle body. The second anti-vibration device 70 includes an elastic base body 73 made of a rubber member formed to be vertically long, and a second outer cylinder 71 provided on the outer circumference of one end portion (an upper end portion in FIG. 3) in the long direction, and a second core material 72 provided at an axial center of the other end portion (a lower end portion).

Figure 4:
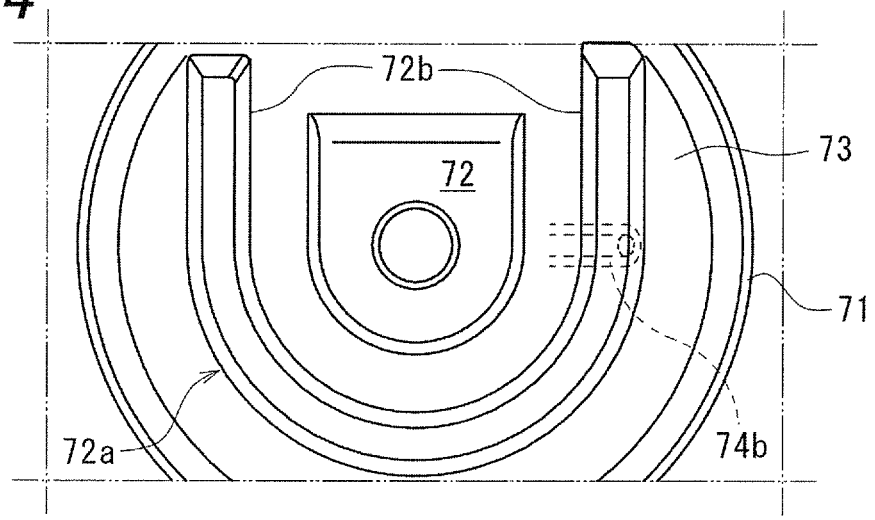
FIG. 4 is a bottom view of the second anti-vibration device.

FIG. 4 is a bottom view of the second anti-vibration device 70. Also referring to FIG. 4, the second core material 72 includes a core material protrusion portion 72*a* that protrudes downward in a letter U shape from the elastic base body 73. The surface of the core material protrusion portion 72*a* is covered with the elastic base body 73.

It is to be noted that in the second outer cylinder 71, an outer diameter D3 at a lower end portion is larger than an outer diameter D1 at a lower end portion of the first outer cylinder 51 of the first anti-vibration device 50 (see FIG. 1). In the second anti-vibration device 70, a height H2 from the second outer cylinder 71 to the lower end portion (that is, the lower end portion of the core material protrusion portion 72*a*) is shorter than a height H1 from the first outer cylinder 51 of a first anti-vibration material 59 to the lower end portion (that is, the lower end portion of the core material protrusion portion 52*a*). In other words, the second anti-vibration device 70 is smaller in the vertical direction and larger in the radial direction than the first anti-vibration device 50.

Although not shown, in the second anti-vibration device 70, a partition member is assembled in a liquid chamber provided at an upper part, and a liquid is sealed by a diaphragm.

Further, the second anti-vibration device 70 includes a second actuator 74 for adjusting the vertical position of the diaphragm. In the same manner as the first actuator 60, the second actuator 74 is secured by externally fitting a lid member 74*a* with the second outer cylinder 71. In the bottom view shown in FIG. 4, in the second actuator 74, the lid member 74*a* is secured to the second outer cylinder 71 so that a nipple 74*b* has a predetermined angle with respect to the core material protrusion portion 72*a*. For example, in the present embodiment, the nipple 74*b* extends in a direction orthogonal to both-end straight line portions 72*b* in a letter U shape of the core material protrusion portion 72*a*.

Next, a process of producing an anti-vibration device will be described. FIGS. 5A to 5F schematically show a process of producing the first anti-vibration device 50. Although the description is omitted, the second anti-vibration device 70 is also produced in the same manner.

Figure 5A:
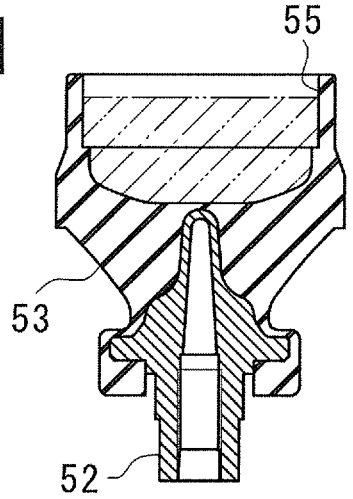
FIGS. 5A to 5F show an assembling process of an anti-vibration device.
Figure 5B:
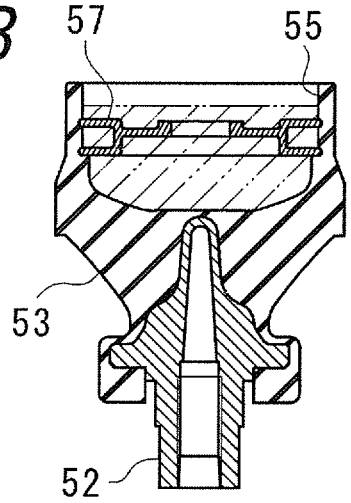
Figure 5C:
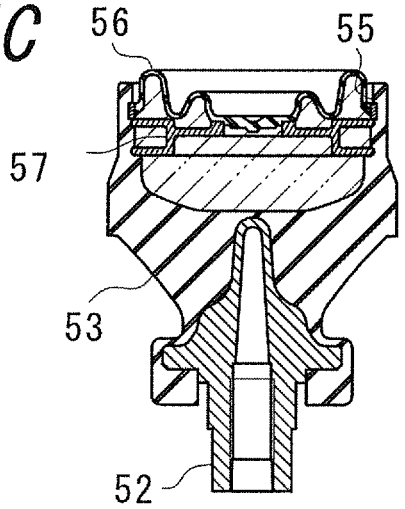
Figure 5D:
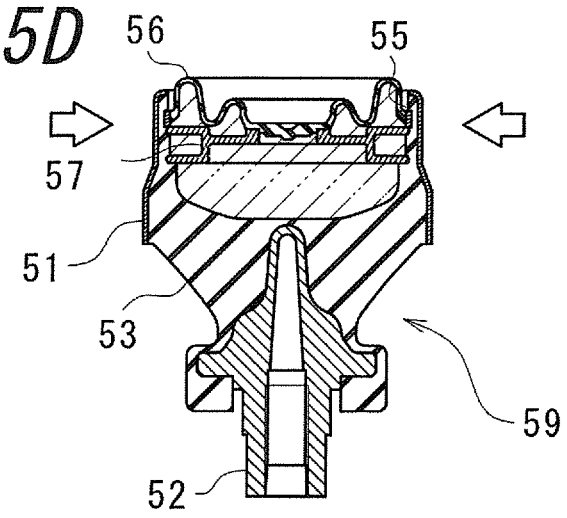

As shown in FIG. 5A, first, the elastic base body 53 with which the first core material 52 is vulcanized and bonded is prepared, and a predetermined amount of liquid (indicated by hatching in two-dot chain lines) is injected into the liquid chamber 55. Next, as shown in FIG. 5B, the partition member 57 is assembled in the liquid chamber 55. Next, as shown in FIG. 5C, the diaphragm 56 is assembled at the opening edge portion of the liquid chamber 55. Next, as shown in FIG. 5D, the first outer cylinder 51 is fitted by insertion of an upper outer circumference of the elastic base body 53 (specifically, at a position in height corresponding to the liquid chamber 55), and the first outer cylinder 51 is caulked inward in the radial direction. Accordingly, the diaphragm 56 and the partition member 57 are secured to the liquid chamber 55, and the liquid is also sealed in the liquid chamber 55. The first anti-vibration material 59, which is a constituent member (also referred to as an in-process product) of the first anti-vibration device 50 is produced.

Figure 5E:
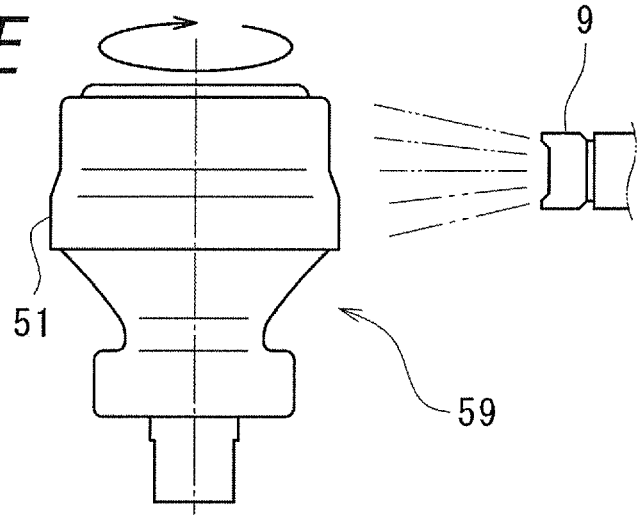
Figure 5F:
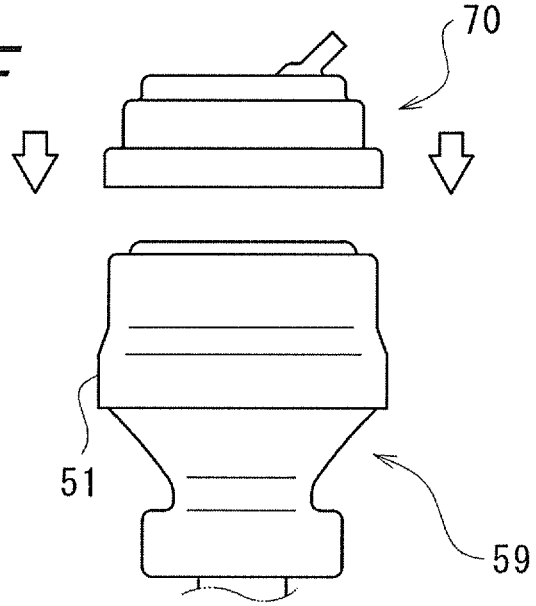

Next, as shown in FIG. 5E, the first outer cylinder 51 is coated with a rust-preventive coating material by using a paint spray 9, while rotating the first anti-vibration material 59 around the axial center. Finally, as shown in FIG. 5F, the first actuator 60 is assembled and secured to the first outer cylinder 51 from above. Accordingly, the first anti-vibration device 50 is produced.

Hereinafter, an actuator assembling device 1 (hereinafter, referred to as an assembling device 1) for assembling an actuator in an anti-vibration material will be described. FIG.

6 is a vertical cross-sectional view schematically showing the assembling device 1, and the first anti-vibration material 59 and the first actuator 60 are indicated by virtual lines.

Figure 6:
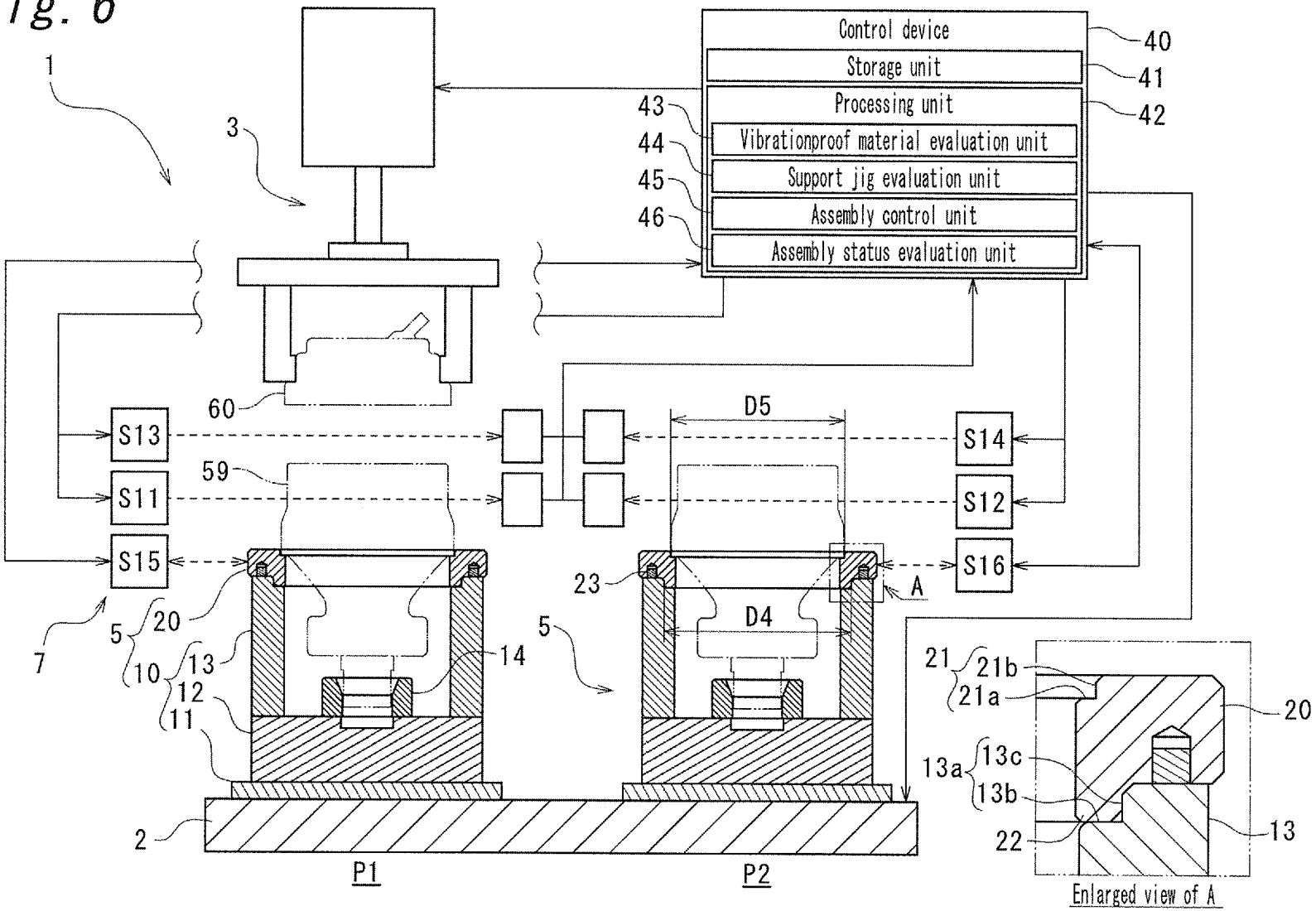
FIG. 6 is a front view of a lid member assembling device.

As shown in FIG. 6, the assembling device 1 includes a support jig 5 for supporting the anti-vibration material, a table 2 on which the support jig 5 is placed, and a robot arm 3 for holding the actuator to assemble the actuator in the anti-vibration material, a plurality of sensors 7 for detecting the type of the anti-vibration material, an assembled state of the actuator, a state of the support jig, and the like, and a control device 40 for controlling an operation of the assembling device 1.

Figure 7:
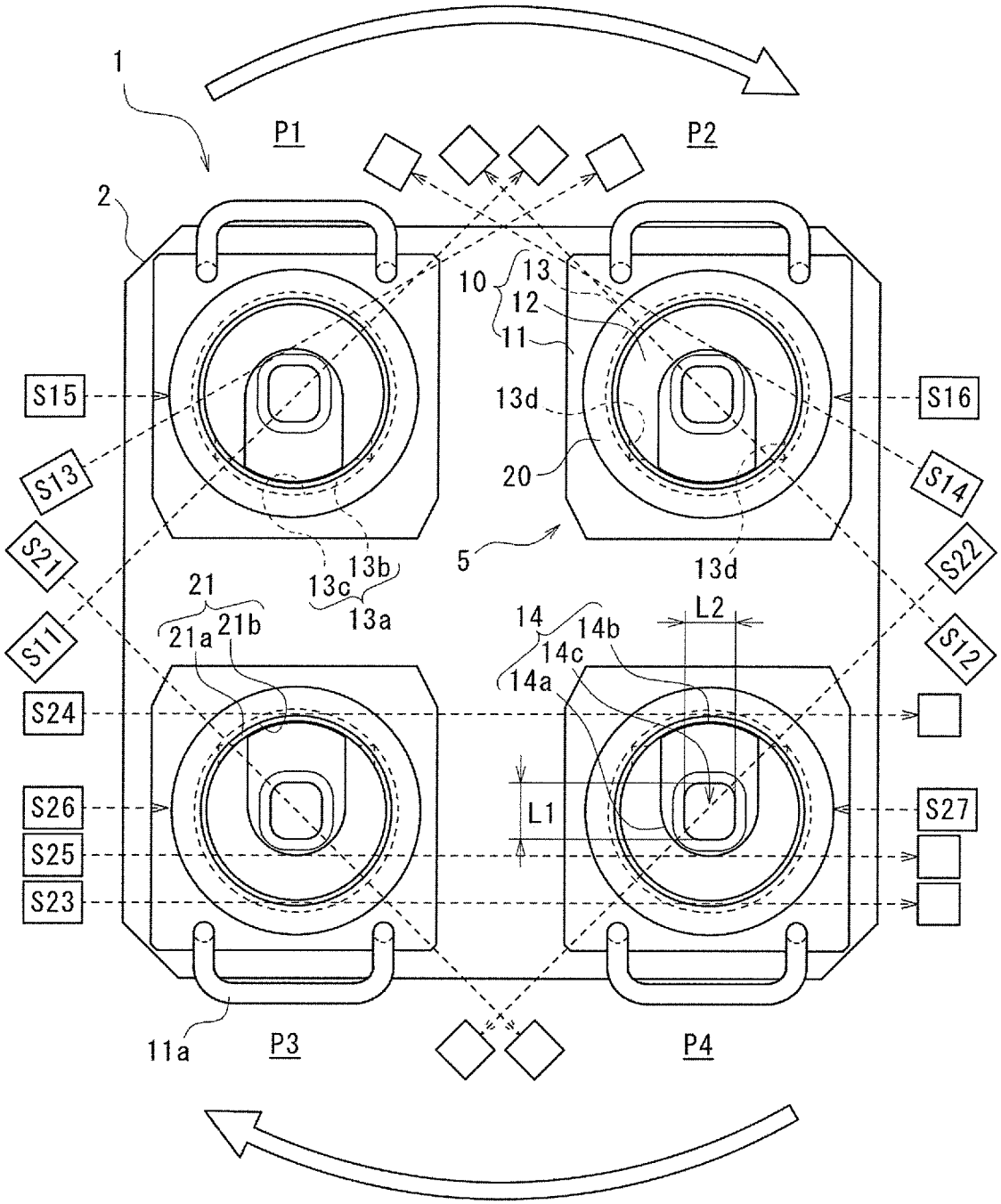
FIG. 7 is a plan view of the lid member assembling device.

FIG. 7 is a plan view of the assembling device 1. As shown in FIG. 7, two pairs of the support jigs 5 are provided on the table 2. In total, four support jigs 5 are provided. In FIG. 7, the positions where a pair of support jigs 5 are positioned on the back side (on the upper side in the drawing) of the table 2 are respectively referred to as a first position P1 and a second position P2, where the actuators are assembled. Further, the positions where a pair of support jigs 5 are positioned on the front side (on the lower side in the drawing) of the table 2 are respectively referred to as a third position P3 and a fourth position P4, which are accessible by a worker.

The table 2 is a turntable configured to be horizontally rotatable. By rotating the table 2 by 180°, the pair of support jigs 5 positioned at the first position P1 and the second position P2 respectively move to the third position P3 and the fourth position P4, and the pair of support jigs 5 positioned at the third position P3 and the fourth position P4 respectively move to the first position P1 and the second position P2.

At the first position P1 and the second position P2, the robot arm 3 sequentially attaches actuators to the anti-vibration materials respectively supported by the pair of support jigs 5. At the third position P3 and the fourth position P4, the worker sets the anti-vibration materials on the pair of support jigs 5, respectively, and removes the anti-vibration devices from the pair of support jigs 5. Therefore, in the assembling device 1, the assembling of the actuators in the anti-vibration materials at the first position P1 and the second position P2 is performed in parallel to the attachment and detachment of the anti-vibration materials and the anti-vibration devices at the third position P3 and the fourth position P4.

Figure 8:
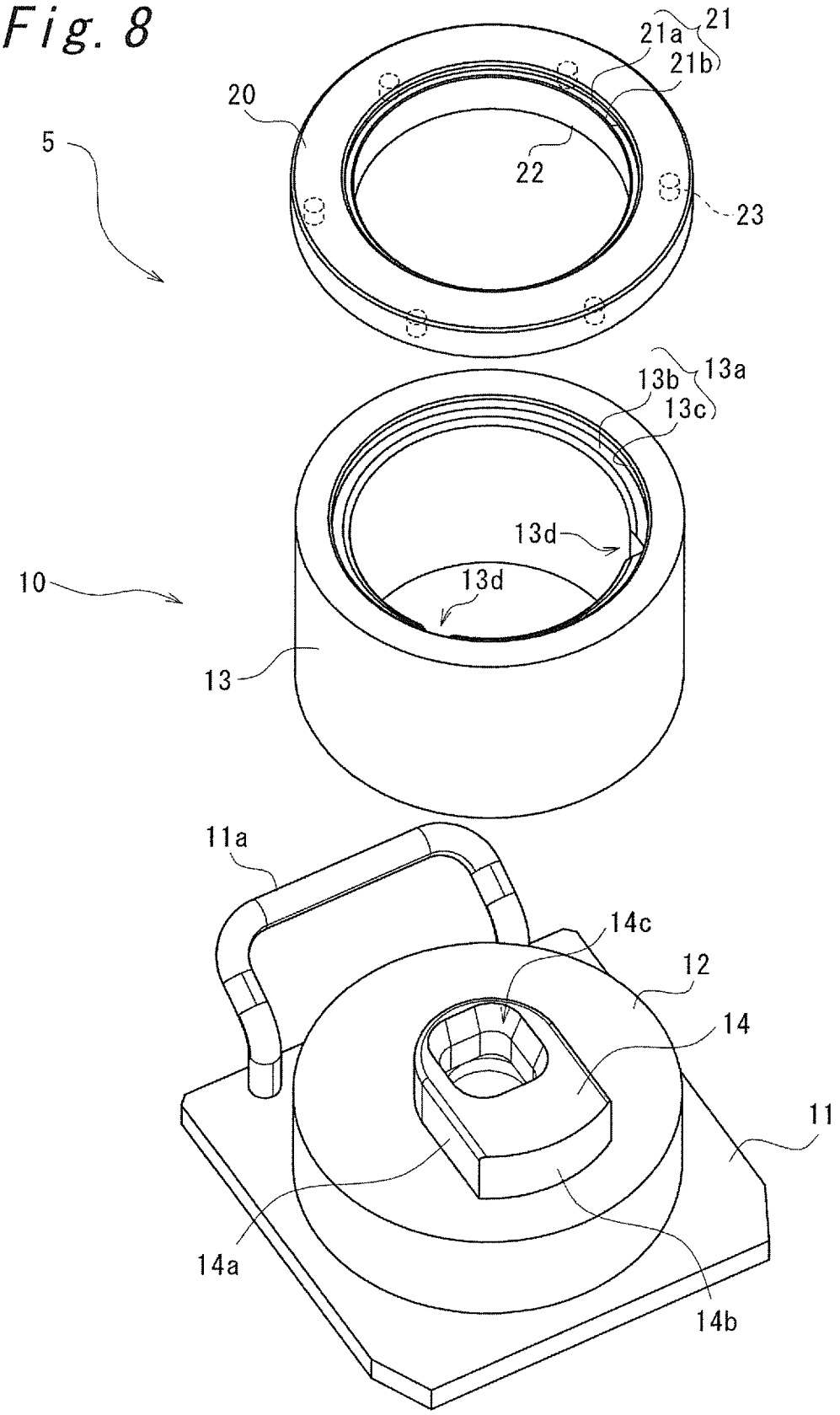
FIG. 8 is an exploded perspective view of a support jig.

FIG. 8 is an exploded perspective view of the support jig 5. With reference to FIGS. 6 to 8, the support jig 5 includes a jig main body 10, which is configured to be capable of accommodating a lower side portion of the anti-vibration material in the inside, specifically, a portion below the outer cylinder, and an adapter 20, which is selectively installed to an upper part of the jig main body 10. The support jig 5 is configured to be capable of supporting the first anti-vibration material 59 from below in a posture in which the axial center is oriented vertically, in a state where the adapter 20 is installed to the jig main body 10. The support jig 5 is configured to be capable of supporting a second anti-vibration material 79 from below in the posture in which the axial center is oriented vertically, in a state where the adapter 20 is not installed to the jig main body 10. It is to be noted that the second anti-vibration material 79 means a member constituting the second anti-vibration device 70 in the same manner as the first anti-vibration material 59. Specifically, the second anti-vibration material 79 is one in which the second actuator 74 is not attached with respect to the second anti-vibration device 70.

The jig main body 10 includes a base 11 to be attached to the turntable 2, a lower support portion 12 having a disc shape and mounted on the base 11, and an upper support portion 13 having a cylindrical shape and mounted on the lower support portion 12. The base 11, the lower support portion 12, and the upper support portion 13 are integrally coupled by, for example, a fastening member. In this manner, by constituting the jig main body 10 by coupling a plurality of members, it is easier to configure the jig main body 10 than a case where the jig main body 10 is formed by, for example, cutting or the like.

The base 11 is a flat metal plate, and is provided with a grip 11*a*. The entire support jig 5 can be lifted up by using the grip 11*a*, and the support jig 5 can be easily attached to and detached from the table 2. The base 11 is positioned by, for example, a knock pin (not shown) and secured to the table 2. The lower support portion 12 is a metal member, and includes a lower positioning portion 14 at the center of an upper end face.

As shown in FIG. 7, the lower positioning portion 14 includes a letter U-shaped wall portion 14*a* having an outer circumference formed in a letter U shape, and an arc-shaped wall portion 14*b* connecting both end portions of the letter U-shaped wall portion 14*a*. The letter U-shaped wall portion 14*a* is formed to extend along and with a minute gap (for example, less than 1 mm) with respect to an inner circumferential portion of the core material protrusion portion 72*a* of the second anti-vibration device 70. The arc-shaped wall portion 14*b* is formed to extend along and with a minute gap (for example, less than 1 mm) with respect to an inner circumferential surface of the upper support portion 13.

Further, the lower positioning portion 14 includes an opening portion 14*c* having a rectangular shape and penetrating vertically in a radial center portion of the lower support portion 12. The opening portion 14*c* is formed in dimension to have a length L1 in the long direction to correspond to the diameter D2 (see FIG. 2) of the core material protrusion portion 52*a*, and is formed in dimension to have a length L2 in the short direction to correspond to the width W between the pair of flat surface portions 52*b* of the core material protrusion portion 52*a*, so that the core material protrusion portion 52*a* of the first anti-vibration device 50 is fitted and inserted into the inside. The opening portion 14*c* is chamfered over the entire circumference of the opening edge portion at the upper end.

The upper support portion 13 is a metal member (for example, iron), which is a magnetic material. The upper support portion 13 includes a main body counterbore portion 13*a* (a first support portion), which is lowered by one step at a radial inner end portion of an upper end face. As shown in the enlarged view of a part A of FIG. 6, the main body counterbore portion 13*a* includes a bottom wall portion 13*b* having an annular shape and extending horizontally, and a circumferential wall portion 13*c* extending upward from an outer circumferential edge portion of the bottom wall portion 13*b*. The circumferential wall portion 13*c* is formed to extend along and with a minute gap (for example, 1 mm) with respect to a lower end portion of the second outer cylinder 71 of the second anti-vibration material 79.

As shown in FIG. 7, the upper support portion 13 includes a pair of vertical groove portions 13*d* extending vertically. The pair of vertical groove portions 13*d* are formed to extend in parallel and at intervals with respect to the both-end straight line portions of the letter U-shaped wall portion 14*a*.

As shown in FIG. 8, the adapter 20 is a metal member having an annular shape. As shown in the enlarged view of the part A of FIG. 6, the adapter 20 includes an adapter counterbore portion 21 (a second support portion), which is lowered by one step at a radial inner end portion of the upper end face, and an adapter protrusion 22, which protrudes downward from the lower end face. The adapter counterbore portion 21 includes a bottom wall portion 21*a* having an annular shape and extending horizontally, and a circumferential wall portion 21*b* extending upward from an outer circumferential edge portion of the bottom wall portion 21*a*. The circumferential wall portion 21*b* is formed to extend along and with a minute gap (for example, 1 mm) with respect to the lower end portion of the first outer cylinder 51 of the first anti-vibration material 59.

The adapter protrusion 22 protrudes downward in an annular shape from the adapter 20. The adapter protrusion 22 is formed to be complementary to the main body counterbore portion 13*a*. The adapter protrusion 22 is configured to be accommodated in the main body counterbore portion 13*a* and to be horizontally positioned while being supported from below by the upper support portion 13, in case where the adapter 20 is attached to an upper face of the upper support portion 13.

Further, as shown in FIGS. 6 and 8, a magnet 23 is embedded in a lower face of the adapter 20. Accordingly, the adapter 20 is secured to the upper face of the upper support portion 13 through the magnet 23, which is magnetically attracted by the upper support portion 13, which is a magnetic material.

Figure 9:
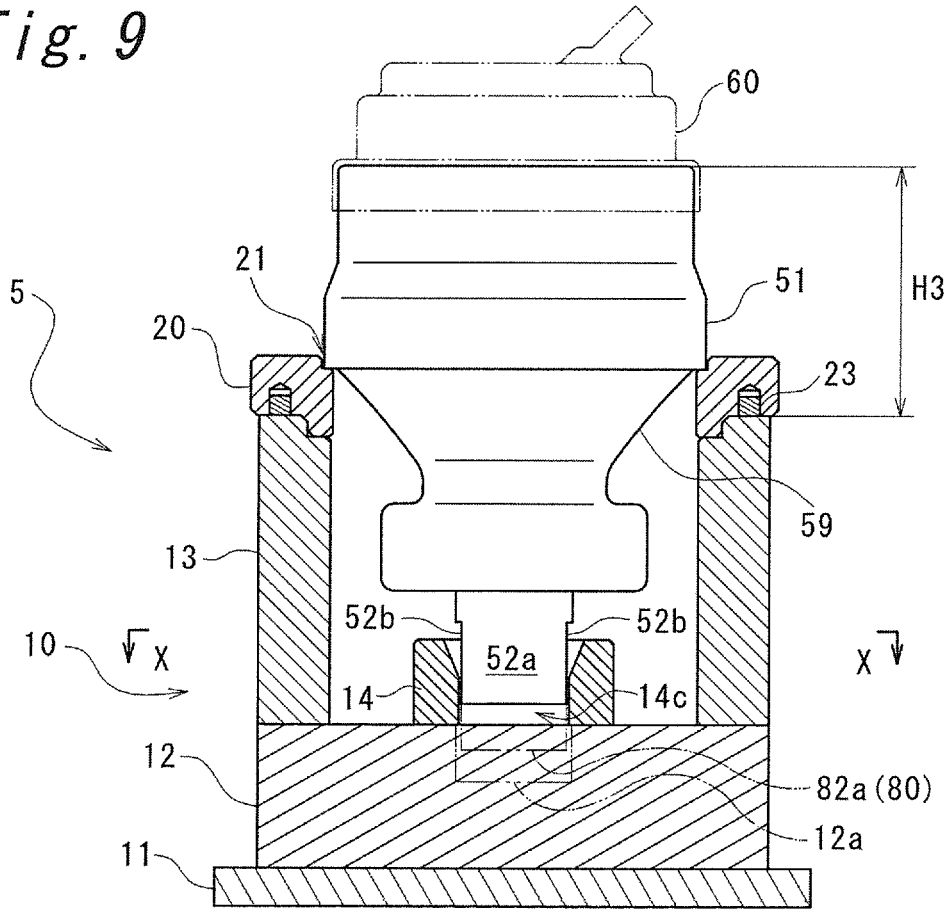
FIG. 9 is a vertical cross-sectional view showing a state where the first anti-vibration material is supported by the support jig.

As shown in FIG. 9, in a case where the support jig 5 supports the first anti-vibration material 59, the adapter 20 is installed on the upper face of the upper support portion 13, and the adapter 20 supports the first anti-vibration material 59, in the support jig 5. Specifically, in the adapter counterbore portion 21 of the adapter 20, the lower end portion of the first outer cylinder 51 of the first anti-vibration material 59 is horizontally positioned by the circumferential wall portion 21*b*, and is supported from below by the bottom wall portion 21*a*.

Figure 10:
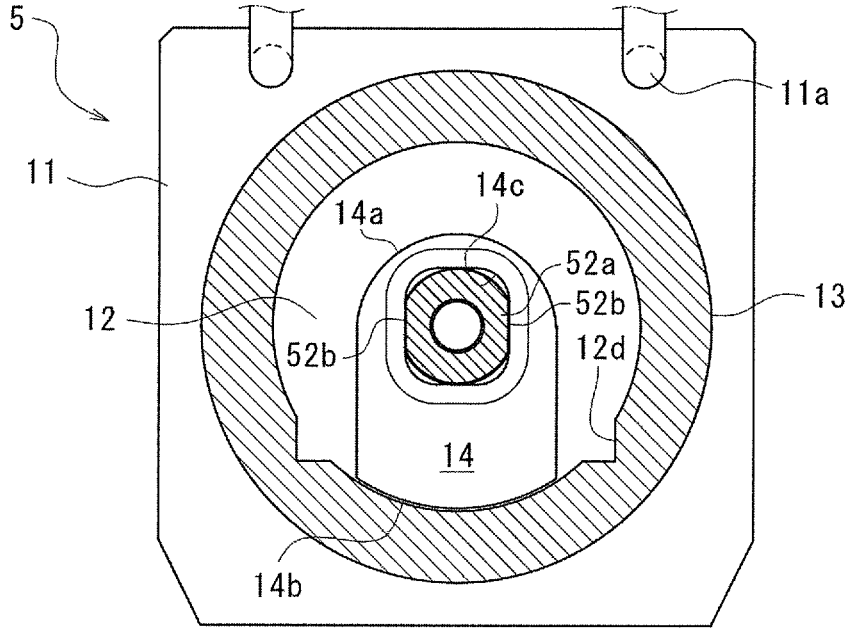
FIG. 10 is a cross-sectional view taken along line X-X of FIG. 9.

In this situation, as shown in FIG. 10, in the first anti-vibration material 59, the core material protrusion portion 52*a* at the lower end is fitted and inserted into the opening portion 14*c* of the lower positioning portion 14. More specifically, the pair of flat surface portions 52*b* of the core material protrusion portions 52*a* face the wall face in the short direction of the opening portion 14*c* with a minute gap. Accordingly, the first anti-vibration material 59 is positioned in the rotation direction around the axial center.

Figure 11:
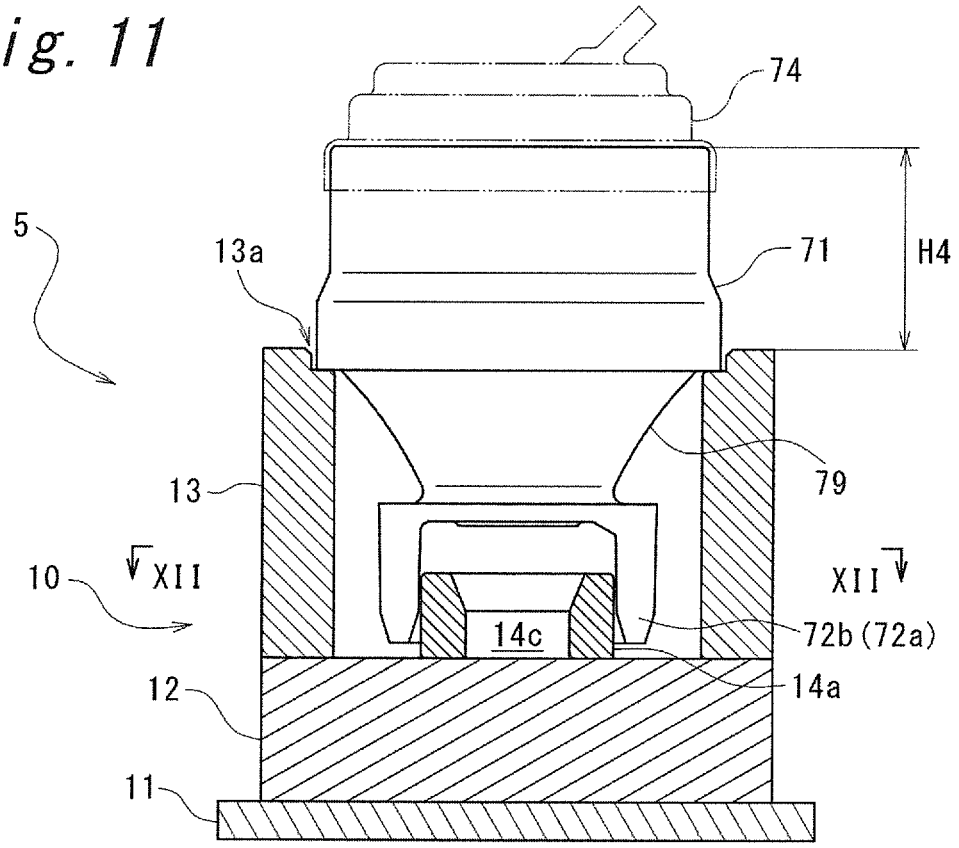
FIG. 11 is a vertical cross-sectional view showing a state where the second anti-vibration material is supported by the support jig.

On the other hand, as shown in FIG. 11, in a case where the second anti-vibration material 79 is supported by the support jig 5, the adapter 20 is removed from the support jig 5, and the second anti-vibration material 79 is supported by the upper support portion 13. Specifically, in the main body counterbore portion 13*a* of the upper support portion 13, the lower end portion of the second outer cylinder 71 of the second anti-vibration material 79 is horizontally positioned by the circumferential wall portion 13*c*, and is supported by the bottom wall portion 13*b* from below.

Figure 12:
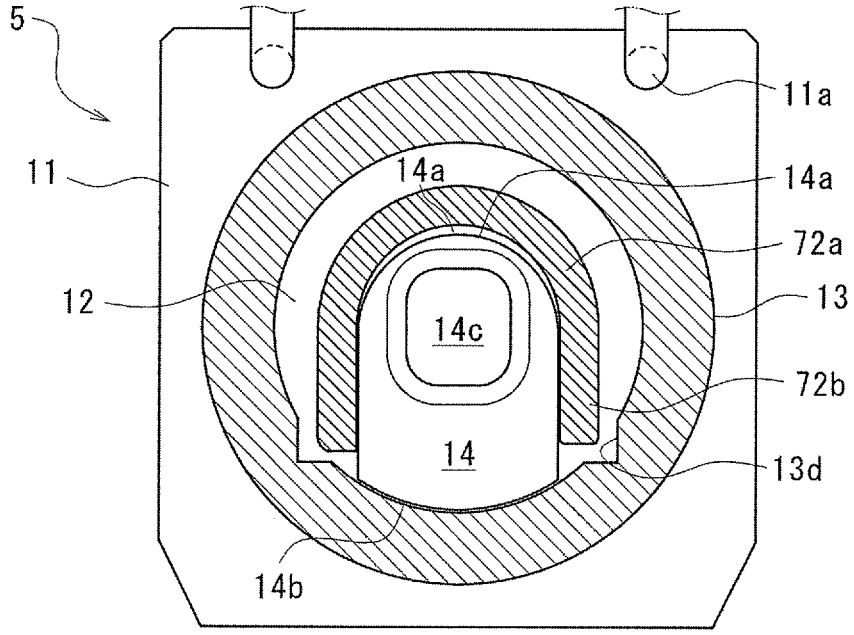
FIG. 12 is a cross-sectional view taken along line XII-XII of FIG. 11.

In this situation, as shown in FIG. 12, in the second anti-vibration material 79, the core material protrusion portion 72*a* at the lower end is externally fitted with the lower positioning portion 14. More specifically, the core material protrusion portion 72*a* faces the letter U-shaped wall portion 14*a* with a minute gap. Accordingly, the second anti-vibration material 79 is positioned in the rotation direction around the axial center.

It is to be noted that as shown in FIG. 6, an inner diameter D5 of the circumferential wall portion 21*b* of the adapter counterbore portion 21 is smaller than an inner diameter D4 of the circumferential wall portion 13*c* of the main body counterbore portion 13*a*. In other words, the inner diameter D5 is smaller than the outer diameter D3 at the lower end portion of the second outer cylinder 71 of the second anti-vibration material 79 (see FIG. 3). Therefore, in the support jig 5, in a state where the adapter 20 is installed on the upper support portion 13, the second anti-vibration material 79 does not fit with the adapter counterbore portion 21. Therefore, the second anti-vibration material 79 cannot be supported while being positioned.

On the other hand, in the support jig 5, in a state where the adapter 20 is not installed on the upper support portion 13, there is a large difference between the inner diameter D4 of the circumferential wall portion 13*c* of the main body counterbore portion 13*a* and the outer diameter D1 of the outer cylinder of the first anti-vibration material 59 (see FIG. 1). Hence, the first anti-vibration material 59 cannot be appropriately positioned at the main body counterbore portion 13*a*.

Further, in a state where the first anti-vibration material 59 and the second anti-vibration material 79 are each supported by the support jig 5, the positions in height are different between the first outer cylinder 51 and the second outer cylinder 71 with the upper end face of the upper support portion 13 as a reference. Specifically, a height position H3 of the upper end portion of the first outer cylinder 51 of the first anti-vibration material 59 with the adapter 20 interposed with respect to the upper support portion 13 (see FIG. 9) is higher than a height position H4 of the upper end portion of the second outer cylinder 71 of the second anti-vibration material 79 without the adapter 20 interposed (see FIG. 11).

As shown in FIGS. 6 and 7, the sensors 7 includes sensors S11 to S16 for detecting support statuses of the anti-vibration material and the anti-vibration device, on the support jigs 5, respectively positioned at the first position P1 and the second position P2, and sensors S21 to S27 for detecting support statuses of the anti-vibration material and the anti-vibration device, on the support jigs 5, respectively positioned at the third position P3 and the fourth position P4.

The sensors S11 and S12 are transmission type sensors each including a light projector and a light receiver, and are provided at height positions so as to be capable of detecting the anti-vibration materials, on the support jigs 5, respectively positioned at the first position P1 and the second position P2. Specifically, the sensors S11 and S12 are provided at height positions so as to be capable of commonly detecting the first outer cylinder 51 of the first anti-vibration material 59 and the second outer cylinder 71 of the second anti-vibration material 79, which are respectively supported by the support jigs 5.

The sensors S13 and S14 are transmission type sensors, and are provided at height positions so as to be capable of detecting the actuators assembled in the anti-vibration materials, on the support jigs 5, respectively positioned at the first position P1 and the second position P2. Specifically, the sensors S13 and S14 are two-dimensional sensors, are configured to be capable of detecting the height position of a target object within a predetermined range in the height direction, and are provided at height positions so as to be commonly capable of detecting the upper end portions of the first actuator 60 installed in the first anti-vibration material 59 and the second actuator 74 installed in the second anti-vibration material 79, which are respectively supported by the support jigs 5.

The sensors S15 and S16 are reflection type sensors, and are provided at height positions so as to be capable of detecting the adapters 20, on the support jigs 5, respectively positioned at the first position P1 and the second position P2.

As shown in FIG. 7, the sensors S21 and S22 are transmission type sensors, and are provided at height positions so as to be capable of detecting the anti-vibration materials, on the support jigs 5, respectively positioned at the third position P3 and the fourth position P4. Specifically, the sensors S21 and S22 are provided at height positions so as to be commonly capable of detecting the first outer cylinder 51 of the first anti-vibration material 59 and the second outer cylinder 71 of the second anti-vibration material 79, which are respectively supported by the support jigs 5.

The sensors S23 and S24 are transmission type sensors, and are provided at height positions so as to be capable of detecting lifts of the pair of anti-vibration materials on the front side and the back side thereof over the pair of anti-vibration materials, which are supported by the support jigs 5, and are respectively positioned at the third position P3 and the fourth position P4. Specifically, the sensors S23 and S24 are two-dimensional sensors, are configured to be capable of detecting the height position of a target object within a predetermined range in the height direction, and are provided at height positions so as to be commonly capable of detecting the upper end portions of the first outer cylinder 51 of the first anti-vibration material 59 and the second outer cylinder 71 of the second anti-vibration material 79, which are respectively supported by the support jigs 5.

The sensor S25 is a transmission type sensor, and is provided at a height position so as to be capable of detecting a lift of the actuator over the pair of anti-vibration devices, which are supported by the support jigs 5, and are respectively positioned at the third position P3 and the fourth position P4. Specifically, the sensor S25 is a two-dimensional sensor, is configured to be capable of detecting the height position of a target object within a predetermined range in the height direction, and is provided at a height position so as to be commonly capable of detecting the upper end portions of the actuator of the first anti-vibration device 50 and the second anti-vibration device 70, which are respectively supported by the support jigs 5.

The sensors S26 and S27 are reflection type sensors, and are provided at height positions so as to be capable of detecting the adapters 20, on the support jigs 5, respectively positioned at the third position P3 and the fourth position P4.

As shown in FIG. 6, the control device 40 includes a known computer equipped with a storage unit 41 such as a hard disk, a processing unit (CPU) 42, a memory, and an input and output device, and software installed in the computer. The processing unit 42 includes an anti-vibration material evaluation unit 43, a support jig evaluation unit 44, an assembly control unit 45, and an assembly status evaluation unit 46.

The storage unit 41 stores reference height positions respectively corresponding to the sensors S13, S14, S23, S24, and S25 for detecting the height positions of the first anti-vibration material 59 and the second anti-vibration material 79, which are respectively supported by the support jigs 5.

The anti-vibration material evaluation unit 43 determines the type of the anti-vibration material supported by the support jig 5 by referring to a reference value that has been read from the storage unit 41, based on a detection result by each sensor 7, determines whether the type that has been determined is the type of a preset production target, and further determines whether the support state of the anti-vibration material supported by the support jig 5 is appropriate. That is, the anti-vibration material evaluation unit 43 determines that the anti-vibration material to be a production target is appropriate, in a case where the anti-vibration material is supported by the support jig 5 without a float or the like.

The support jig evaluation unit 44 determines the presence or absence of the adapter 20, based on detection results of the sensors S15, S16, S26 and S27, and determines whether the presence or absence of the adapter 20 corresponds to the anti-vibration device that is a preset production target.

For example, in a case where the first anti-vibration material 59 is a preset production target, the support jig evaluation unit 44 determines that the support jig 5 is appropriate upon a detection of the adapter 20 and that the support jig 5 is inappropriate upon no detection of the adapter 20. On the other hand, in a case where the second anti-vibration material 79 is a preset production target, the support jig evaluation unit 44 determines that the support jig 5 is inappropriate upon a detection of the adapter 20 and that the support jig 5 is appropriate upon no detection of the adapter 20.

In a case where the determinations that have been made by the anti-vibration material evaluation unit 43 and the support jig evaluation unit 44 are appropriate, the assembly control unit 45 controls the robot arm 3 to press the actuator against the anti-vibration material to an appropriate height position according to the type, and assembles the actuator.

The assembly status evaluation unit 46 determines whether the actuator has been installed to an appropriate height position on the anti-vibration material from detection results of the sensors S13, S14, and S25.

Figure 13:
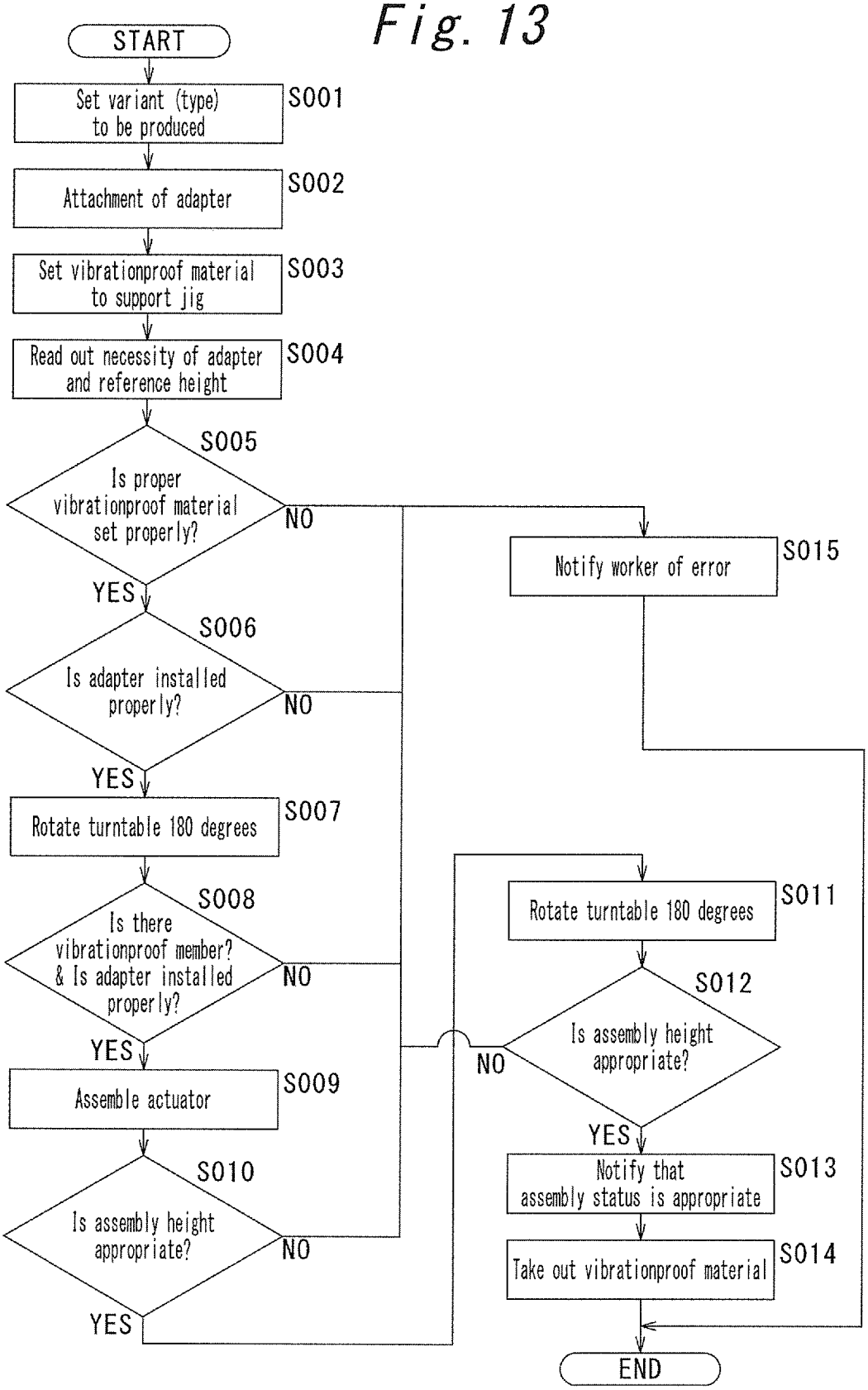
FIG. 13 is a flowchart describing an operation of an assembling device.

Next, an operation of the assembling device 1 when assembling the anti-vibration device 50 will be described with reference to a flowchart of FIG. 13. First, as an anti-vibration device to be a production target, for example, a worker sets the first anti-vibration device 50 in the control device 40 via an input means, not shown (step S001).

Next, the worker attaches the adapters 20 on all the support jigs 5 positioned at the first to fourth positions P1 to P4 (step S002). Next, the worker sets the first anti-vibration materials 59 onto the support jigs respectively positioned at the third position P3 and the fourth position P4 (step S003). In this situation, the first anti-vibration material 59 is positioned and supported by the adapter counterbore portion 21 of the adapter 20 at the lower end portion of the first outer cylinder 51.

In this state, the control device 40 reads, from the storage unit 41, whether the adapter 20 has to be installed, the reference height positions of the respective units, and the like, based on the type information of a preset production target (step S004). It is to be noted that since the first anti-vibration device 50 is a production target, the installation of the adapter 20 is needed.

Next, the control device 40 determines whether the first anti-vibration material 59 is set onto the support jig 5 in a proper posture without a lift or the like, by referring to the detection results by the sensors S21 to S27 (step S005), and also determines whether the adapter 20 is installed (step S006). In a case where the above determination results are YES, the control device 40 rotates the turntable 2 by 180° to move the first anti-vibration materials 59 set at the third position P3 and the fourth position P4 respectively to the first position P1 and the second position P2 (step S007).

Next, the control device 40 determines whether the first anti-vibration material 59 is present and the adapter 20 is installed, based on the detection results from the sensors 7

(step S008). In a case where the determination result is YES, the control device 40 controls the robot arm 3 to assemble the first actuator 60 with respect to the first anti-vibration material 59 from above to a predetermined height position (step S009).

Next, the control device 40 determines whether the height position of the first actuator 60 is appropriate based on the detection results from the sensors 7 (step S010). In a case where the determination result is YES, the control device 40 rotates the turntable 2 by 180° to move the first anti-vibration devices 50, in which the first actuators 60 are respectively assembled at the first position P1 and the second position P2, to the third position P3 and the fourth position P4 (step S011).

Next, the control device 40 determines whether the first actuators 60 of the first anti-vibration device 50 positioned at the third position P3 and the fourth position P4 are each assembled at an appropriate height position, based on the detection results from the sensors 7 (step S012). In a case where the determination result is YES, the control device 40 notifies the worker that the first actuators 60 are appropriately assembled, via a display device, not shown (step S013). Finally, the worker takes out the first anti-vibration devices 50 positioned at the third position P3 and the fourth position P4 (step S014).

In a case where any of the above determinations is determined to be NO, the control device 40 notifies the worker of an error via a notification device, not shown (step S015). Accordingly, the worker can confirm the presence or absence of a problem, and an occurrence of defective assembling of the actuator is prevented.

In a case where the type of a production target is changed from the first anti-vibration device 50 to the second anti-vibration device 70, it is sufficient for the worker only to set the second anti-vibration device 70 as the type of the production target in the control device 40, and also to remove the adapter 20 from the support jig 5. Subsequently, the operation of the assembling device 1 is controlled by the control device 40 in the same manner as the first anti-vibration device 50.

According to the assembling device 1 according to the above embodiment, the following effects can be obtained.

(1) The support jig 5 is capable of positioning and supporting the first anti-vibration material 59 in a case where the adapter 20 is used, and is capable of positioning and supporting the second anti-vibration material 79 in a case where the adapter 20 is not used. That is, the support jig 5 is capable of positioning and supporting the first anti-vibration material 59 and the second anti-vibration material 79 horizontally, by selectively attaching the adapter 20 to the jig main body 10. Accordingly, it is sufficient to selectively attach the adapter 20 having a light weight according to the type of the anti-vibration material to be supported. Therefore, detachment of the jig main body 10 is no longer necessary. Therefore, a changeover operation of the support jig 5 according to the anti-vibration device to be a production target can be performed by selectively installing the adapter 20 in a shorter period than a case where the entire support jig 5 is replaced. Therefore, downtime of the assembling device 1 due to the changeover can be shortened. Therefore, the productivity of the assembling device 1 is improved, and additionally, the productivity of a production line including the assembling device 1 is improved.

(2) The adapter 20 can be easily positioned with respect to the jig main body 10 by fitting the adapter protrusion 22 in the main body counterbore portion 13*a*.

(3) Further, the lower end portion of the second outer cylinder 71 of the second anti-vibration material 79 is positioned and supported at the main body counterbore portion 13*a*. Therefore, the upper support portion 13 can be simplified, as compared to a case where a positioning portion for positioning the adapter 20 and a positioning portion for positioning the second anti-vibration material 79 are individually provided. Accordingly, the cost of the support jig 5 can be reduced.

(4) The adapter 20 is secured to the upper support portion 13, which is a magnetic material, by a magnetic force of the magnet 23. Therefore, the adapter 20 can be easily attached to the jig main body 10 and the time necessary for the changeover operation can be shortened, as compared to a case where the adapter 20 is attached to the jig main body 10 by a fastening member.

(5) The first anti-vibration material 59 and the second anti-vibration material 79 are positioned in the rotation direction around the axial center by the lower positioning portion 14, in a state in which the first anti-vibration material 59 and the second anti-vibration material 79 are supported by the support jig 5. Therefore, it is easy to assemble the actuator in the anti-vibration material while restricting the nipple in a predetermined direction.

(6) Further, the support jig 5 is configured to use the adapter 20, in a case of supporting the first anti-vibration material 59, which is longer downward from a lower end portion of the outer cylinder among the first anti-vibration material 59 and the second anti-vibration material 79. Accordingly, the first anti-vibration material 59 is lifted upward to the height of the adapter 20. Therefore, it is easy to suppress an increase in dimension of the height direction of the jig main body 10, while the jig main body 10 accommodates the first anti-vibration material 59 in the inside. Accordingly, it is easy to configure the jig main body 10 to be compact.

(7) The assembling device 1 is capable of determining whether the type of the anti-vibration material and the support status are appropriate, based on the detection results by the sensors 7, and also determining whether the support jig is appropriate so as to properly assemble the actuator in the anti-vibration material. Therefore, a defect in the assembling of the actuator in the anti-vibration material can be suppressed.

In the above embodiment, two types of the first anti-vibration material 59 and the second anti-vibration material 79 are positioned and supported by selectively attaching the adapter 20. However, three or more types of anti-vibration materials may be supported. In this case, a plurality of adapters that match the lower end portion of the outer cylinder may be prepared. In a case where the shape of the lower end portion of the outer cylinder is the same, a common adapter may be used, or the upper support portion 13 may be commonly supported.

For example, as indicated by two-dot chain lines in FIG. 9, in a case where a third anti-vibration material 80, in which the shape of the first outer cylinder 51 is the same as that of the first anti-vibration material 59 and the position of a core material protrusion portion 82*a* is further positioned downward, is supported, a recess portion 12*a* may be provided with the lower support portion 12 at a position corresponding to the opening portion 14*c* of the lower positioning portion 14 to accommodate the core material protrusion portion 82*a* of the third anti-vibration material 80, so as to prevent the core material protrusion portion 82*a* from reaching the bottom of the lower support portion 12.

It is to be noted that the present invention is not limited to the configurations that have been described in the above embodiment, and various modifications can be made.

What is claimed is:

1. A support jig for an anti-vibration material, the support jig supporting the anti-vibration material, which is a constituent element of a anti-vibration device and which includes an outer cylinder having a tubular shape, at the outer cylinder from below in a posture in which an axial line is vertically oriented, the support jig comprising:

a jig main body that accommodates a lower part of the anti-vibration material in an inside; and an adapter configured to be selectively attachable onto an upper part of the jig main body, wherein the support jig is configured to be capable of supporting a plurality of types of anti-vibration materials including a first anti-vibration material and a second anti-vibration material, the first anti-vibration material including a first outer cylinder, the second anti-vibration material including a second outer cylinder, the second outer cylinder having a diameter different from a diameter of the first outer cylinder, wherein the jig main body includes, at an upper end portion, a first support portion for supporting the first anti-vibration material from below while horizontally positioning the first anti-vibration material at the first outer cylinder, in a state where no adapter is attached, wherein the adapter includes, at an upper end portion, a second support portion for supporting the second anti-vibration material from below while horizontally positioning the second anti-vibration material at the second outer cylinder, in a state where the adapter is attached, and wherein the adapter is installed on the jig main body by being attracted by a magnetic force.

2. The support jig for the anti-vibration material according to claim 1, wherein the jig main body includes a counterbore portion, wherein the adapter includes a protrusion having an annular shape and protruding downward, and wherein the adapter is positioned with respect to the jig main body by fitting the protrusion in the counterbore portion, in a state where the adapter is installed on an upper part of the jig main body.

3. The support jig for the anti-vibration material according to claim 2, wherein the counterbore portion is realized by the first support portion.

4. The support jig for the anti-vibration material according to claim 1, wherein the jig main body includes a positioning portion that positions a lower end portion of the anti-vibration material in a rotation direction around an axial center of the lower end portion.

5. The support jig for the anti-vibration material according to claim 1, wherein a length from the second outer cylinder of the second anti-vibration material to a lower end portion of the second anti-vibration material is longer than a length from the first outer cylinder of the first anti-vibration material to a lower end portion of the first anti-vibration material.

6. The support jig for the anti-vibration material according to claim 1, wherein the jig main body is configured such that an upper support portion having a cylindrical shape and a lower support portion having a disc shape are connected with each other.

7. The support jig for the anti-vibration material according to claim 4, wherein the positioning portion is configured to be capable of positioning one of the lower end portions of the first anti-vibration material and the second anti-vibration material by external fitting, and to be capable of positioning the other one of the lower end portions by internal fitting.

8. An assembling device for a anti-vibration device, the assembling device comprising:

a support jig for an anti-vibration material, which is a constituent element of the anti-vibration device and which includes an outer cylinder having a tubular shape, at the outer cylinder from below in a posture in which an axial line is vertically oriented; and a robot arm that assembles an actuator to the anti-vibration material mounted on the support jig, wherein the support jig comprising:

a jig main body that accommodates a lower part of the anti-vibration material in an inside; and an adapter configured to be selectively attachable onto an upper part of the jig main body, wherein the support jig is configured to be capable of supporting a plurality of types of anti-vibration materials including a first anti-vibration material and a second anti-vibration material, the first anti-vibration material including a first outer cylinder, the second anti-vibration material including a second outer cylinder, the second outer cylinder having a diameter different from a diameter of the first outer cylinder, wherein the jig main body includes, at an upper end portion, a first support portion for supporting the first anti-vibration material from below while horizontally positioning the first anti-vibration material at the first outer cylinder, in a state where no adapter is attached, wherein the adapter includes, at an upper end portion, a second support portion for supporting the second anti-vibration material from below while horizontally positioning the second anti-vibration material at the second outer cylinder, in a state where the adapter is attached, and wherein the adapter is installed on the jig main body by being attracted by a magnetic force.

9. The assembling device for the anti-vibration device according to claim 8, further comprising a sensor that detects a presence or absence of an adapter on the support jig.

10. The assembling device for the anti-vibration device according to claim 8, further comprising a sensor that detects a posture of the anti-vibration material mounted on the support jig.

11. The assembling device for the anti-vibration device according to claim 8, further comprising a sensor that detects the actuator assembled in the anti-vibration material mounted on the support jig.

* * * * *